US012168932B2

(12) United States Patent
Wang et al.

(10) Patent No.: US 12,168,932 B2
(45) Date of Patent: Dec. 17, 2024

(54) THREE-DIMENSIONAL VENTILATION METHOD AND SYSTEM FOR MINING BY 110 CONSTRUCTION METHOD IN COAL AND GAS OUTBURST MINES

(71) Applicant: China University Of Mining And Technology, Beijing, Beijing (CN)

(72) Inventors: Jiong Wang, Beijing (CN); Wenfei Li, Beijing (CN); Zimin Ma, Beijing (CN); Guangyuan Yu, Beijing (CN); Manchao He, Beijing (CN); Gonghua Chen, Beijing (CN); Guoqiang Xiao, Beijing (CN)

(73) Assignee: China University Of Mining and Technology, Beijing, Beijing (CN)

( * ) Notice: Subject to any disclaimer, the term of this patent is extended or adjusted under 35 U.S.C. 154(b) by 42 days.

(21) Appl. No.: 17/922,066

(22) PCT Filed: Apr. 30, 2021

(86) PCT No.: PCT/CN2021/091459
§ 371 (c)(1),
(2) Date: Oct. 28, 2022

(87) PCT Pub. No.: WO2021/219130
PCT Pub. Date: Nov. 4, 2021

(65) Prior Publication Data

US 2023/0175398 A1 Jun. 8, 2023

(30) Foreign Application Priority Data

Apr. 30, 2020 (CN) ..... 202010367085.2

(51) Int. Cl.
*E21F 1/00* (2006.01)
*E21F 7/00* (2006.01)

(52) U.S. Cl.
CPC ..... *E21F 1/006* (2013.01); *E21F 7/00* (2013.01)

(58) Field of Classification Search
CPC ..... E21F 1/00; E21F 1/006; E21F 1/08; E21F 7/00
See application file for complete search history.

(56) References Cited

U.S. PATENT DOCUMENTS 2,859,682 A 11/1958 Joy

FOREIGN PATENT DOCUMENTS

CN 102536239 A 7/2012
CN 109083674 A * 12/2018 ..... E21F 1/006
(Continued)

*Primary Examiner* — Frederick L Lagman
(74) *Attorney, Agent, or Firm* — Wong Meyer Smith & McConnell

(57) ABSTRACT

The present disclosure relates to the technical field of mine ventilation, and in particular, to a three-dimensional ventilation method and system for mining by 110 construction method in coal and gas outburst mines. The three-dimensional ventilation method comprises: constructing a first process roadway and/or a second process roadway before stopping the working face; forming a first roof-cutting and roadway retaining section by a part of the working face track gate located in the goaf, and/or forming a second roof-cutting and roadway retaining section by a part of the working face transport gate located in the goaf during the stopping process of the working face, so that the air inlet of the first roof-cutting and roadway retaining section enters the gas drainage air return roadway through the first process roadway to form return air, and/or the inlet air of the second roof-cutting and roadway retaining section enters the gas drainage air inlet roadway through the second process roadway to form return air, the three-dimensional ventilation system is constructed by using the gas drainage air inlet roadway and the gas drainage air return roadway, during the
(Continued)

conversion from the 121 construction method to the 110 construction method, a complete ventilation system can be formed in the roadway retaining section, real-time monitoring of the roadway retaining section can be carried while eliminating harmful gas accumulation in the retaining section.

8 Claims, 2 Drawing Sheets

(56) References Cited

FOREIGN PATENT DOCUMENTS

| | | | | | |
|---|---|---|---|---|---|
| CN | 109899105 | A | | 6/2019 | |
| CN | 111622795 | A | | 9/2020 | |
| CN | 111636870 | A | * | 9/2020 | ..... E21C 41/18 |
| CN | 111828083 | A | * | 10/2020 | ..... E21C 41/18 |
| CN | 111927556 | A | * | 11/2020 | ..... E21F 17/00 |
| CN | 112922657 | A | * | 6/2021 | ..... E21D 9/14 |
| CN | 115234275 | A | * | 10/2022 | |
| KR | 20160094649 | A | * | 8/2016 | |
| KR | 20200081823 | A | * | 7/2020 | |

* cited by examiner

THREE-DIMENSIONAL VENTILATION METHOD AND SYSTEM FOR MINING BY 110 CONSTRUCTION METHOD IN COAL AND GAS OUTBURST MINES

CROSS-REFERENCE TO RELATED DISCLOSURES

This application is a 371 of international PCT/CN2021/091459, filed Apr. 30, 2021, which claims the priority of Chinese patent application No. 202010367085.2 filed on Apr. 30, 2020 with the Patent Office of the National Intellectual Property Administration of the People's Republic of China, titled a three-dimensional ventilation method and system for mining by 110 construction method in coal and gas outburst mines, of which the entire contents are incorporated by reference.

FIELD

The present disclosure relates to the technical field of coal mining, and in particular, to a three-dimensional ventilation method and system for mining by 110 construction method 110 in coal and gas outburst mines.

BACKGROUND

At present, in the process of coal mining, the construction 121 method as shown in FIG. 1 is usually used, that is, two roadways need to be excavated for one working face first, and a coal pillar is left as a support. Specifically, each working face comprises an upper gate, a lower gate and a mining working face. In the current structure, coal pillars need to be left, resulting in a lot of waste of resources. Moreover, each working face needs to be excavated two roadways, and the work efficiency is low.

Self-forming roadway construction method "110" with roof cutting and pressure relief and without coal pillars is an advanced coal mining technology without coal pillars and one of the key technologies to maintain the sustainable development of China's coal resources. It is an important guarantee for reducing the tunnel excavation rate and realizing scientific mining. Construction method "110" without pillar mining technology means that after the mining roadway is reinforced and supported, directional pre-split blasting is carried out on the side of the roadway where the goaf will be formed, and the roof is cut according to the design position, with the mining of the coal seam in the working face, under the action of the mine pressure, the roof of the goaf collapses along the pre-split slit to form a roadway, and a new roadway is automatically formed by using part of the space and support of the original roadway as the mining roadway of the next working face. The mining technology of self-forming roadway without coal pillars reduces the pressure of the stope roof acting on the roadway by using technical means such as pre-split blasting, constant resistance anchor cable reinforcement support, and rear gangue, and does not leave a section of coal pillars, while one mining roadway is less excavated for each mining working face, which reduces the excavation rate of 10,000 tons of coal mines. Especially in coal and gas outburst coal mines, one less mining roadway can reduce the workload and time of gas control by about 50%, and solve the problem of difficult replacement of coal and gas outburst coal mines.

According to the existing technology, it is necessary to convert a large number of existing traditional "121" construction methods to "110" construction method of roof-cutting and roadway retaining, but there is no air return passage in the roof-cutting and roadway retaining section formed by the "110" construction method, unable to form a perfect return air system, which brings many safety hazards to coal mine production. Therefore, in the early stage of the conversion from "121" construction method to "110" construction method, when the "110" construction method is used to cut the roof and keep the roadway before the Y-shaped ventilation or W-shaped ventilation is formed, the roadway retaining section cannot form a perfect air return system, which will cause problems. As a result, the change of surrounding rock cannot be monitored in the retaining section, the accumulation of toxic and harmful gases in the retaining section, and the inability to drill in the retaining section for gas control, etc., and also increase the economic cost of coal mining.

SUMMARY

In order to solve the above technical problems, the present disclosure provides the following technical solutions.

In a first aspect, the present disclosure provides a three-dimensional ventilation method for mining by 110 construction method in coal and gas outburst mines.

The three-dimensional ventilation method is suitable for the coal mining area, and the ventilation system of the coal mining area comprises an air inlet main roadway, an air return main roadway, a coal mining working face, a working face transport gate, a working face track gate, a gas drainage air inlet roadway and a gas drainage air return roadway, wherein, the three-dimensional ventilation method comprises the following steps:

constructing a first process roadway and/or a second process roadway before stopping the working face, wherein one end of the first process roadway is connected with an end of the working face track gate away from the air return main roadway, the other end of the first process roadway is connected with the gas drainage air return roadway, one end of the second process roadway is connected with an end of the working face transport gate away from the air inlet main roadway, the other end of the second process roadway is connected with the gas drainage air inlet roadway; and forming a first roof-cutting and roadway retaining section by a part of the working face track gate located in the goaf, and/or forming a second roof-cutting and roadway retaining section by a part of the working face transport gate located in the goaf during the stopping process of the working face, so that the air inlet of the first roof-cutting and roadway retaining section enters the gas drainage air return roadway through the first process roadway to form return air, and/or the inlet air of the second roof-cutting and roadway retaining section enters the gas drainage air inlet roadway through the second process roadway to form return air.

Optionally, a ventilation line of the ventilation system is:

the air is fed through the gas drainage air inlet roadway and the working face transport gate, and the air is returned through the gas drainage air return roadway and the working face track gate; and a part of the inlet air of the working face transport gate is diverted to the coal mining working face and then returned by the working face track gate, the other part of the inlet air of the working face transport gate is diverted to the second roof-cutting and roadway retaining section and then merges with the inlet air of the gas drainage air inlet roadway, then enters the gas drainage air return roadway for return air.

Further, a part of the working face transport gate located in the goaf forms a second roof-cutting and roadway retaining section during the stopping process of the working face, and a part of the working face track gate located in the goaf does not retain roadway.

Optionally, the ventilation line of the ventilation system is:

the air is fed through the gas drainage air inlet roadway and the working face transport gate, and returned through the gas drainage air return roadway and the working face track gate; and after the inlet air of the working face transport gate passes the coal mining working face, a part of it is diverted to the working face track gate for return air, the other part flows to the first roof-cutting and roadway retaining section and enters the gas drainage air return roadway through the first process roadway for return air.

Further, during the stopping process of the working face, a part of the working face transport gate located in the goaf does not retain roadway, and a part of the working face track gate located in the goaf forms the first top-cutting and roadway retaining section.

Optionally, the ventilation line of the ventilation system is:

the air is fed through the gas drainage air inlet roadway, the working face transport gate and the working face track gate, and returned through the gas drainage air return roadway.

a part of the inlet air of the working face transport gate is diverted to the coal mining working face and merges with the inlet air of the working face track gate, and then passes the first roof-cutting and roadway retaining section and the first process roadway in turn, then enters the gas drainage air return roadway to form return air; and the other part of the inlet air of the working face transport gate is diverted to the second roof-cutting and roadway retaining section, then merges with the inlet air of the gas drainage air inlet through the second process roadway, and then enters the gas drainage air return roadway to form return air.

Further, during the stopping process of the working face, a part of the working face track gate located in the goaf forms the first roof-cutting and roadway retaining section, and a part of the working face transport gate located in the goaf forms the second roof-cutting and roadway retaining section.

In a second aspect, the present disclosure provides a three-dimensional ventilation system for mining by 110 construction method of coal and gas outburst mines, configured to realize the three-dimensional ventilation method described in the first aspect.

The ventilation system comprises an air inlet main roadway, an air return main roadway, a coal mining face, a working face transport gate, a working face track gate, a gas drainage air inlet roadway, a gas drainage air return roadway, a first roof-cutting and roadway retaining section and a second roof-cutting and roadway retaining section, a part of the working face track gate located in the goaf forms the first roof-cutting and roadway retaining section and/or a part of the working face transport gate located in the goaf forms the second roof-cutting and roadway retaining section, the ventilation system further comprises a first process roadway or a second process roadway, one end of the first process roadway is connected with an end of the first roof-cutting and roadway retaining section away from the air return main roadway, the other end of the first process roadway is connected with the gas drainage air return roadway, one end of the second process roadway is connected with an end of the second roof-cutting and roadway retaining section away from the air inlet main roadway, the other end of the second process roadway is connected with the gas drainage air inlet roadway.

Compared with the prior art, the above-mentioned technical solutions provided in the embodiments of the present disclosure have the following advantages: in the coal and gas outburst mine, the existing gas drainage air inlet roadway and gas drainage air return roadway is configured to construct the three-dimensional ventilation system. During the conversion from 121 construction method to 110 construction method, a complete ventilation system can be formed. While realizing the ventilation of the roadway retaining section, real-time monitoring of the roadway retaining section can be performed and the accumulation of harmful gases in the roadway retaining section can be eliminated.

BRIEF DESCRIPTION OF THE DRAWINGS

The accompanying drawings, which are incorporated in and constitute a part of this specification, illustrate embodiments consistent with the disclosure and together with the description serve to explain the principles of the disclosure.

In order to more clearly illustrate the embodiments of the present disclosure or the technical solutions in the prior art, the following briefly introduces the accompanying drawings that need to be used in the description of the embodiments or the prior art. In other words, on the premise of no creative labor, other drawings can also be obtained from these drawings.

In the figures.

Figure 1:
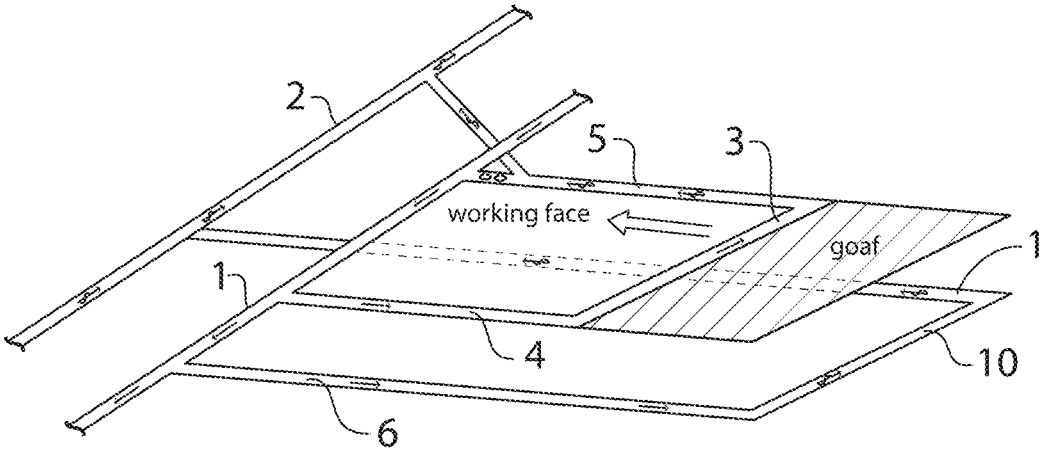
FIG. 1 (PRIOR ART)
FIG. 1 is a schematic diagram of a ventilation system of coal and gas outburst mine using 121 construction method in the prior art.

1. Air inlet main roadway;
2. Air return main roadway;
3. Coal mining working face;
4. Working face transport gate;
5. Working face track gate;
6. Gas drainage air inlet roadway;
7. Gas drainage air return roadway;
8. First process roadway;
9. Second process roadway;
10. Short roadway;
11. First roof-cutting and roadway retaining section;
12. Second roof-cutting and roadway retaining section;
13. Inclined roadway;
14. First regulating damper;
15. Second regulating damper;
16. Third regulating damper;
17. Fourth regulating damper.

DETAILED DESCRIPTION

In order to make those skilled in the art better understand the solutions of the present disclosure, the technical solutions in the embodiments of the present disclosure will be clearly and completely described below with reference to the accompanying drawings in the embodiments of the present disclosure. Obviously, the described embodiments are only part of the embodiments of the present disclosure, but not all of the embodiments. Based on the embodiments in the present disclosure, all other embodiments obtained by those of ordinary skill in the art without creative work shall fall within the protection scope of the present disclosure.

It should be noted that the terms "first", "second", etc. in the description and claims of the present disclosure and the above drawings are used to distinguish similar objects, and are not necessarily used to describe a specific sequence or sequence. It is to be understood that the data so used are interchangeable under appropriate circumstances for the embodiments of the disclosure described herein. Furthermore, the terms "comprising" and "having" and any variations thereof, are intended to cover non-exclusive inclusion, for example, a process, method, system, product or device comprising a series of steps or units is not necessarily limited to those expressly listed Rather, those steps or units may comprise other steps or units not expressly listed or inherent to these processes, methods, products or devices.

In this disclosure, the orientation or positional relationship indicated by the terms "upper", "lower", "inner", "middle", "outer", "front", "rear", etc. is based on the orientation or position shown in the drawings relation. These terms are primarily used to better describe the present disclosure and its embodiments, and are not intended to limit the fact that the indicated device, element, or component must have a particular orientation, or be constructed and operated in a particular orientation.

In addition, some of the above-mentioned terms may be used to express other meanings besides orientation or positional relationship. For example, the term "on" may also be used to express a certain attachment or connection relationship in some cases. For those of ordinary skill in the art, the specific meanings of these terms in the present disclosure can be understood according to specific situations.

Furthermore, the terms "arranged", "connected", "fixed" should be construed broadly. For example, "connection" may be a fixed connection, a detachable connection, or a unitary construction; it may be a mechanical connection, or an electrical connection; it may be a direct connection, or an indirect connection through an intermediary, or two devices, elements or internal connectivity between components. For those of ordinary skilled in the art, the specific meanings of the above terms in this disclosure can be understood according to specific situations.

It should be noted that the embodiments in the present disclosure and the features of the embodiments may be combined with each other in the case of no conflict. The present disclosure will be described in detail below with reference to the accompanying drawings and in conjunction with the embodiments.

As shown in FIG. 1, a schematic diagram of a ventilation system of coal and gas outburst mine using 121 construction method in the prior art is shown. As shown in the figure, each working face is correspondingly provided with a working face transport gate 4, a working face track gate 5 and a coal mining working face 3, the working face transport gate 4 of each working face is connected with the air inlet main roadway 1, the working face track gate 5 of each working face is connected with the air return main roadway 2. A gas drainage air inlet roadway 6 and a gas drainage air return roadway 7 for gas drainage are also provided, the gas drainage air inlet roadway 6 and the gas drainage and air return roadway 7 are connected through the short roadway 10 to form a ventilation circuit. In the current structure, coal pillars need to be left, resulting in a lot of waste of resources. In addition, each working face needs to be excavated with two gates and two gas drainage roadways, resulting in serious mining disorders in the mine.

In order to make full use of the advanced mining technology, a large number of mines have been transitioned from the 121 construction method to the 110 construction method. After the mine shown in FIG. 1 is mined by the 110 construction method, a part of the working face track gate 5 located in the goaf will form the first roof-cutting and roadway retaining section, a part of the working face transport gate 4 located in the goaf will form the second roof-cutting and roadway retaining section. If the "110" construction method is used to cut the roof and retain the roadway before the Y-type ventilation or W-type ventilation is formed, the roadway retaining section cannot form a perfect return air system, this construction method has the following problems: the lack of a perfect ventilation system leads to the inability of personnel to enter, the real-time monitoring of the change of the surrounding rock of the roadway cannot be carried out, and the change data of the surrounding rock cannot be grasped, which affects the change of the surrounding rock in the roadway section. After the roadway retaining section is sealed, toxic and harmful gases in the goaf and adjacent coal seams continue to pour in, which may easily lead to personnel poisoning and gas explosion and other safety accidents in the process of reusing the roadway retaining section; after sealing the roadway retaining section, it is impossible to construct the next mining face gas drainage borehole and the gas control project in the adjacent coal seam in the road retaining section, which increases the time of the gas control project, leads to mining imbalance, and affects the production progress of the coal mine; it increases the economic cost of roadway retaining and reduces the enterprise economic benefits of coal mine.

The ventilation line in the ventilation system shown in FIG. 1 is:

(1) Fresh air flow →air inlet main roadway 1 →working face transport gate 4 →coal mining working face 3 →working face track gate 5 →air return main roadway 2.

(2) Fresh air flow →air inlet main roadway 1 →gas drainage air inlet roadway 6 →short roadway 10 →gas drainage air return roadway 7 →air return main roadway 2.

In order to solve the above technical problems, the embodiment of the present disclosure provides a three-dimensional ventilation method for mining by 110 construction method in coal and gas outburst mines, which is suitable for coal mining areas. The ventilation system of the coal mining area comprises an air inlet main roadway 1, an air return main roadway 2, a coal mining working face 3, a working face transport gate 4, a working face track gate 5, a gas drainage air inlet roadway 6 and a gas drainage air return roadway 7, wherein the three-dimensional ventilation method comprises the following steps:

constructing the first process roadway 8 or the second process roadway 9 before stopping the working face, wherein one end of the first process roadway 8 is connected with an end of the working face track gate 5 away from the air return main roadway 2, the other end of the first process roadway 8 is connected with the gas drainage air return roadway 7, one end of the second process roadway 9 is connected with an end of the working face transport gate 4 away from the air inlet main roadway 1, the other end of the second process roadway 9 is connected with the gas drainage air inlet roadway 6;

During the stopping process of the working face, a part of the working face track gate 5 located in the goaf forms a first roof-cutting and roadway retaining section 11, or a part of the working face transport gate 4 located in the goaf forms a second roof-cutting and roadway retaining section 12, so that the air inlet of the first roof-cutting and roadway retaining section 11 enters the gas drainage air return roadway 7 through the first process roadway 8 to form return air, and/or the inlet air of the second roof-cutting and roadway retaining section 12 enters the gas drainage air inlet roadway 6 through the second process roadway 9 to form return air.

The three-dimensional ventilation method provided in an embodiment of the present disclosure is applied to coal and gas outburst mines, and can make full use of the gas drainage air inlet roadway 6 and gas drainage air return roadway 7 of the three-dimensional ventilation system to form a three-dimensional ventilation system. A complete ventilation system can be formed during the conversion from 121 construction method to 110 construction method. While achieving the ventilation of the roadway retaining section, real-time monitoring of the roadway retaining section can be performed and the accumulation of harmful gas in the roadway retaining section can be eliminated.

Figure 2:
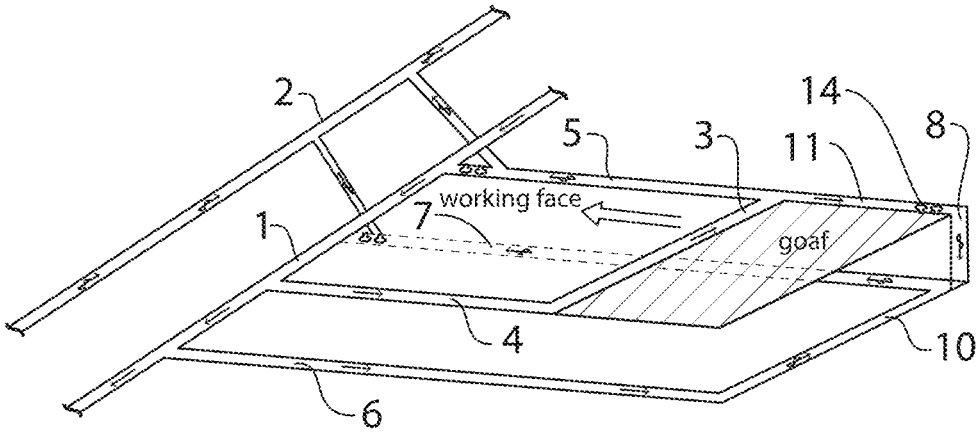
FIG. 2 is a schematic diagram of a three-dimensional ventilation system for mining by 110 construction method in coal and gas outburst mines in an embodiment of the present disclosure.

As an optionally embodiment, as shown in FIG. 2, the three-dimensional ventilation system for mining by 110 construction method in coal and gas outburst mines comprises an air inlet main roadway 1, an air return main roadway 2, a coal mining face 3, a working face transport gate 4, a working face track gate 5, a gas drainage air inlet roadway 6, a gas drainage air return roadway 7, a first roof-cutting and roadway retaining section 11, wherein a part of the working face track gate 5 located in the goaf forms the first roof-cutting and roadway retaining section 11, the ventilation system further comprises a first process roadway 8, one end of the first process roadway 8 is connected with an end of the first roof-cutting and roadway retaining section 11 away from the air return main roadway 2, the other end of the first process roadway 8 is connected with the gas drainage air return roadway 7. The working face transport gate 4 and the gas drainage air inlet roadway 6 are all connected with the air inlet main roadway 1, the working face track gate 5 and the gas drainage air return roadway 7 are all connected with the air return main roadway 2. A first regulating damper 14 is arranged inside an end of the working face track gate 5 connected with the first process roadway 8 (that is, the first roof-cutting and roadway retaining section 11 after stopping), the air intake from the coal mining working face 3 to the first roof-cutting and roadway retaining section 11 is controlled by the first regulating damper 14.

The ventilation lines of the three-dimensional ventilation system in FIG. 2 are: The air is fed through the gas drainage air inlet roadway 6 and the working face transport gate 4, and the air is returned through the gas drainage air return roadway 7 and the working face track gate; After the inlet air of the working face transport gate 4 passes the coal mining working face 3, a part of it is diverted to the working face track gate 5 for return air, the other part flows to the first roof-cutting and roadway retaining section 11 and enters the gas drainage air return roadway 7 through the first process roadway 8 for return air. That is, it will comprise at least the following ventilation sub-circuits:

(1) Fresh air flow →air inlet main roadway 1 →working face transport gate 4 →coal mining working face →first roof-cutting and roadway retaining section 11 →gas drainage air return roadway 7 →air return main roadway 2;

(2) Fresh air flow →air inlet main roadway 1 →working face transport gate 4 →coal mining working face →working face track gate 5 →air return main roadway 2;

(3) Fresh air flow →air inlet main roadway 1 →gas drainage air inlet roadway 6 →short roadway 10 →gas drainage air return roadway 7 →air return main roadway 2.

The three-dimensional ventilation system in FIG. 2 and the corresponding method is preferably suitable for the following situations: during the stopping process of the working face, the part of the working face transport gate 4 located in the goaf does not leave a roadway, the part of the working face track gate 5 located in the goaf forms the first roof-cutting and roadway retaining section 11, that is, the next working face is only arranged on one side of the working face track gate 5, and the working face track gate 5 adopts a roof-cutting and pressure relief to form the first roof-cutting and roadway retaining section 11. There is no need to arrange the next mining working face on the side of the working face transport gate 4, and the working face transport gate 4 is no longer reserved with the advancement of stopping.

Figure 3:
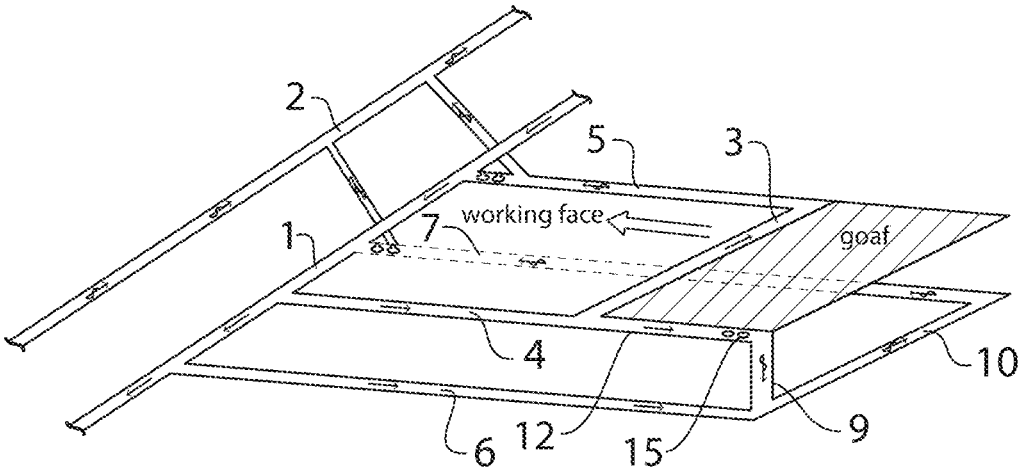
FIG. 3 is a schematic diagram of another three-dimensional ventilation system for mining by 110 construction method in coal and gas outburst mines in an embodiment of the disclosure.

As an optionally embodiment, as shown in FIG. 3, the three-dimensional ventilation system for mining by construction method 110 in coal and gas outburst mines comprises an air inlet main roadway 1, an air return main roadway 2, a coal mining face 3, a working face transport gate 4, a working face track gate 5, a gas drainage air inlet roadway 6, a gas drainage air return roadway 7 and a second roof-cutting and roadway retaining section 12, wherein a part of the working face transport gate 4 located in the goaf forms the second roof-cutting and roadway retaining section 12, the ventilation system further comprises a second process roadway 9, one end of the second process roadway 9 is connected with an end of the second roof-cutting and roadway retaining section 12 away from the air return main roadway 2, the other end of the second process roadway 9 is connected with the gas drainage air inlet roadway 6. The working face transport gate 4 and the gas drainage air inlet roadway 6 are all connected with the air inlet main roadway 1, the working face track gate 5 and the gas drainage air return roadway 7 are all connected with the air return main roadway 2. A second regulating damper 15 is arranged inside an end of the working face transport gate 4 connected with the second process roadway 9 (that is, the second roof-cutting and roadway retaining section 12 after stopping), the air intake from the coal mining working face 3 to the second roof-cutting and roadway retaining section 12 is controlled by the second regulating damper 15, The ventilation lines of the three-dimensional ventilation system in FIG. 3 are: The air is fed through the gas drainage air inlet roadway 6 and the working face transport gate 4, and the air is returned through the gas drainage air return roadway 7 and the working face track gate 5; A part of the inlet air of the working face transport gate 4 is diverted to the coal mining working face 3 and then returned by the working face track gate 5, the other part of the inlet air of the working face transport gate 4 is diverted to the second roof-cutting and roadway retaining section 12 and then merges with the inlet air of the gas drainage air inlet roadway 6 through the second process roadway 9, then enters the gas drainage air return roadway through the short roadway 10 for return air. That is, it will comprise at least the following ventilation sub-circuits:

(1) Fresh air flow air →inlet main roadway 1 →working face transport gate 4 →coal mining working face →first roof-cutting and roadway retaining section 11 →gas drainage air return roadway 7 →air return main roadway 2;

(2) Fresh air flow →air inlet road 1 →working face transport gate 4 →second roof-cutting and roadway retaining section 12 →second process roadway 9 →gas drainage air inlet roadway 6 →short roadway 10 →gas drainage air return roadway 7 →air return main roadway 2;

(3) Fresh air flow →air inlet main roadway 1 →gas drainage air inlet roadway 6 →short roadway 10 →gas drainage air return roadway 7 →air return main roadway 2.

The three-dimensional ventilation system and the corresponding three-dimensional ventilation method shown in FIG. 3 are preferably applicable to the following situations: during the stopping process of the working face, a part of the working face transport gate 4 located in the goaf forms the second roof-cutting and roadway retaining section 12, a part of the working face track gate 5 located in the goaf does not retain roadway, that is, the next mining face is arranged only on one side of the working face transport gate 4, and the working face transport gate 4 adopts a roof-cutting and pressure relief method to form the second roof-cutting and roadway retaining section 12. There is no need to arrange the next mining working face on one side of the working face track gate 5, and the working face track gate 5 is no longer reserved with the advancement of stopping.

Figure 4:
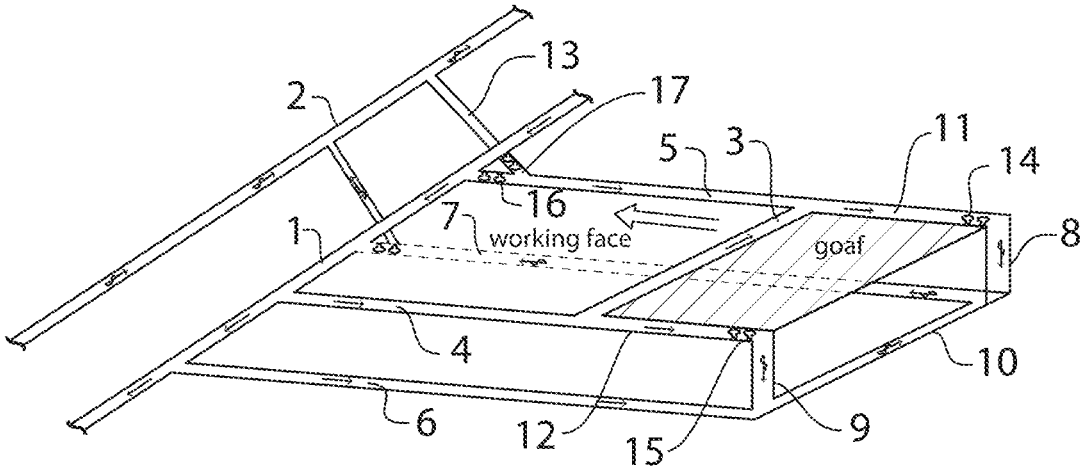
FIG. 4 is a schematic diagram of another three-dimensional ventilation system for mining by 110 construction method in coal and gas outburst mines in an embodiment of the present disclosure.

As an optionally embodiment, as shown in FIG. 4, the three-dimensional ventilation system for mining by construction method 110 in coal and gas outburst mines comprises an air inlet main roadway 1, an air return main roadway 2, a coal mining face 3, a working face transport gate 4, a working face track gate 5, a gas drainage air inlet roadway 6, a gas drainage air return roadway 7, a first second roof-cutting and roadway retaining section 11 and a second roof-cutting and roadway retaining section 12, wherein a part of the working face track gate 5 located in the goaf forms the first roof-cutting and roadway retaining section 11, a part of the working face transport gate 4 located in the goaf forms the second roof-cutting and roadway retaining section 12, the ventilation system further comprises a first process roadway 8 and a second process roadway 9, one end of the first process roadway 8 is connected with an end of the first roof-cutting and roadway retaining section 11 away from the air return main roadway 2 (that is, the first roof-cutting and roadway retaining section 11 after stopping), the other end of the first process roadway 8 is connected with the gas drainage air return roadway 7. One end of the second process roadway 9 is connected with an end of the second roof-cutting and roadway retaining section 12 away from the air return main roadway 2 (that is, the second roof-cutting and roadway retaining section 12 after stopping), the other end of the second process roadway 9 is connected with the gas drainage air inlet roadway 6. The working face transport gate 4, the working face track gate 5 and the gas drainage air inlet roadway 6 are all connected with the air inlet main roadway 1, the gas drainage air return roadway 7 is connected with the air return main roadway 2. A first regulating damper 14 is arranged inside an end of the working face track gate 5 connected with the first process roadway 8 (that is, the first roof-cutting and roadway retaining section 11 after stopping), a second regulating damper 15 is arranged inside an end of the working face transport gate 4 connected with the second process roadway 9 (that is, the second roof-cutting and roadway retaining section 12 after stopping), the air intake from the coal mining working face 3 to the first roof-cutting and roadway retaining section 11 is controlled by the first regulating damper 14, and the air intake from the coal mining working face 3 to the second roof-cutting and roadway retaining section 12 is controlled by the second regulating damper 15.

The ventilation lines of the three-dimensional ventilation system in FIG. 4 are: The air is fed through the gas drainage air inlet roadway 6, the working face transport gate 4 and the working face track gate 5, and the air is returned through the gas drainage air return roadway 7; A part of the inlet air of the working face transport gate 4 is diverted to the coal mining working face 3 and merges with the inlet air of the working face track gate 5, and then passes the first roof-cutting and roadway retaining section 11 and the first process roadway 8 in turn, then enters the gas drainage air return roadway 7 to form return air; The other part of the inlet air of the working face transport gate 4 is diverted to the second roof-cutting and roadway retaining section 12, then merges with the inlet air of the gas drainage air inlet 6 through the second process roadway 9, and then enters the gas drainage air return roadway 7 to form return air. That is, it will comprise at least the following ventilation sub-circuits:

(1) Fresh air flow →air inlet main roadway 1 →working face track gate 5 →first roof-cutting and roadway retaining section 11 →gas drainage air return roadway 7 →air return main roadway 2;

(2) Fresh air flow →air inlet road 1 →working face transport gate 4 → →mining working face →first roof-cutting and roadway retaining section 11 →gas drainage air return roadway 7 →air return main roadway 2;

(3) Fresh air flow →air inlet main roadway 1 →working face transport gate 4 →second roof-cutting and roadway retaining section 12 →gas drainage air inlet roadway 6 →short roadway 10 →gas drainage air return roadway 7 →air return main roadway 2.

(4) Fresh air flow →air inlet main roadway 1 →gas drainage air inlet roadway 6 →short roadway 10 →gas drainage air return roadway 7 →air return main roadway 2.

The three-dimensional ventilation system and the corresponding three-dimensional ventilation method shown in FIG. 4 are preferably applicable to the following situations: during the stopping process of the working face, a part of the working face track gate 5 located in the goaf forms the first roof-cutting and roadway retaining section 11, a part of the working face transport gate 4 located in the goaf forms the second roof-cutting and roadway retaining section 12, a part of the working face track gate 5 located in the goaf does not retain roadway, that is to say, the next stopping face is arranged on one side of the working face transport gate 4 and one side of the working face track gate 5, the working face track gate 5 adopts a roof-cutting and pressure relief method to form the first roof-cutting and roadway retaining section 11, the working face transport gate 4 adopts a roof-cutting and pressure relief method to form the second roof-cutting and roadway retaining section 12, the gates on both sides need to be retained as the stopping progresses.

On the basis of the above-mentioned embodiments, in order to select an appropriate ventilation method according to the actual situation and realize the switching between the three-dimensional ventilation method shown in FIG. 4 and the three-dimensional ventilation method shown in FIG. 2 or 3, the three-dimensional ventilation system shown in FIG. 4 is provided with an inclined roadway 13, one end of the working face transport gate 4, the working face track gate 5 and the gas drainage air inlet roadway 6 are all connected with the air inlet main roadway 1, the working face track gate 5 and the air return main roadway 2 are connected through the inclined alley 13. The working face track gate 5 is provided with a third regulating damper 16 located between the connection of the working face track gate 5 and air inlet main roadway 1 and the connection of the working face track gate 5 and the inclined roadway 13. A fourth regulating damper 17 is provided in the inclined roadway 13, the third regulating damper 16 can be used to open or close the connection of the working face track gate 5 and the air inlet main roadway 1 and to close or adjust the air volume. The fourth damper can be used to open or close the connection of the working face track gate 5 and the air return main roadway 2 and to close or adjust the air volume. By providing the third regulating damper 16 and the fourth regulating damper 17, the working face track gate can be switched between the two functions of air intake and air return, so as to realize the switching of different ventilation modes. For example in the working face shown in FIG. 4, the working face track gate 5 is used for air intake. During the stopping process of the next working face, the working face track gate 5 (after the stopping of this working face is completed, the working face track gate 5 will all become the first roof-cutting and roadway retaining section) can be used for return air by adjusting of the third regulating damper 16 and the fourth regulating damper 17.

Preferably, the first regulating damper 14, the second regulating damper 15, the third regulating damper 16 and the fourth regulating damper 17 shown in FIGS. 2-4 are all two-way adjustable dampers, which can be controlled remotely by electronic dampers.

The following technical effects can be achieved by using the ventilation system and the corresponding ventilation method as shown in FIGS. 3-5 provided by the examples:

(1) Speeding up the progress of the road retaining project, forming a perfect ventilation system, which reduces the labor intensity of workers; after the stopping is completed, it is directly reused, and it is no longer necessary to dismantle the airtight, speeding up the progress of the roadway retention project.

(2) The roadway retaining section can be monitored in real time. After the sealing of the roadway retaining section is cancelled, the surrounding rock change monitoring instrument is installed in the roadway, and personnel can enter and exit at any time to monitor the change of the surrounding rock in the roadway in real time, and master the data of the surrounding rock change, which is convenient for the research and promotion of the surrounding rock change law of the road retaining section.

(3) Toxic and harmful gases no longer accumulate in the roadway retaining section. After the sealing of the roadway retaining section is cancelled, the toxic and harmful gases in the goaf and adjacent coal seams are discharged from the ground along with the wind flow, and do not accumulate, reducing safety accidents such as personnel poisoning and gas explosion.

(4) The roadway retaining section can be drilled for gas control. After the sealing of the roadway retaining section is cancelled, it is possible to make overall arrangements for the construction of the next road-retaining face gas drainage borehole and the gas control project of the adjacent coal seam, so as to reduce the time of the gas control project and solve the problem of mining replacement difficulties in the mine.

(5) Reduce the economic cost of coal mines. After the sealing of the roadway retaining section is cancelled, the economic cost of road retaining will be reduced and the economic benefits of coal mining enterprises will be improved.

The corresponding arrangement position and connection relationship of each unmentioned structure in this disclosure, the mutual timing and control parameters of each unmentioned step can refer to similar devices and methods in the prior art, the connection relationship of each unmentioned structure, The operation and working principle are known to those of ordinary skill in the art and will not be described in detail here.

Some embodiments in this specification are described in a progressive manner, and each embodiment focuses on the differences from other embodiments, and the same and similar parts between the various embodiments can be referred to each other.

The above are only specific embodiments of the present invention, so that those skilled in the art can understand or implement the present invention. Various modifications to these embodiments will be readily apparent to those skilled in the art, and the generic principles defined herein may be implemented in other embodiments without departing from the spirit or scope of the invention. Therefore, the present invention is not intended to be limited to the embodiments shown herein, but is to be accorded the widest scope consistent with the principles and novel features claimed herein.

What is claimed is:

1. A three-dimensional ventilation method for mining by 110 construction method in coal and gas outburst mines, suitable for a coal mining area, wherein a ventilation system of the coal mining area comprises an air inlet main roadway, an air return main roadway, a coal mining working face, a working face transport gate, a working face track gate, a gas drainage air inlet roadway and a gas drainage air return roadway, wherein, the three-dimensional ventilation method comprises:

constructing a first process roadway and/or a second process roadway before stopping the working face, wherein one end of the first process roadway is connected with an end of the working face track gate away from the air return main roadway, the other end of the first process roadway is connected with the gas drainage air return roadway, one end of the second process roadway is connected with an end of the working face transport gate away from the air inlet main roadway, the other end of the second process roadway is connected with the gas drainage air inlet roadway; and forming a first roof-cutting and roadway retaining section by a part of the working face track gate located in a goaf, and/or forming a second roof-cutting and roadway retaining section by a part of the working face transport gate located in the goaf during a stopping process of the working face, so that the air inlet of the first roof-cutting and roadway retaining section enters the gas drainage air return roadway through the first process roadway to form return air, and/or the inlet air of the second roof-cutting and roadway retaining section enters the gas drainage air inlet roadway through the second process roadway to form return air.

2. The three-dimensional ventilation method of claim 1, further comprising the steps of:

providing a ventilation line of the ventilation system;

feeding air is through the gas drainage air inlet roadway and the working face transport gate;

returning the air through the gas drainage air return roadway and the working face track gate; and diverting a first part of inlet air of the working face transport gate to the coal mining working face and then returning the first part of the inlet air by the working face track gate;

diverting a second part of the inlet air of the working face transport gate to the second roof-cutting and roadway retaining section; and merging the second part of the inlet air with the inlet air of the gas drainage air inlet roadway through the second process roadway, and then entering the gas drainage air return roadway for return air.

3. The three-dimensional ventilation method of claim 2, wherein, a part of the working face transport gate located in the goaf forms a second roof-cutting and roadway retaining section during the stopping process of the working face, and a part of the working face track gate located in the goaf does not retain roadway.

4. The three-dimensional ventilation method of claim 1, further comprising the steps of:

providing a ventilation line of the ventilation system;

feeding air through the gas drainage air inlet roadway and the working face transport gate;

returning the air through the gas drainage air return roadway and the working face track gate;

after inlet air of the working face transport gate passes the coal mining working face, diverting a first part of the air to the working face track gate for return air; and diverting a second part of the air to the first roof-cutting and roadway retaining section and entering the gas drainage air return roadway through the first process roadway for return air.

5. The three-dimensional ventilation method of claim 4, wherein, during the stopping process of the working face, a part of the working face transport gate located in the goaf does not retain roadway, and a part of the working face track gate located in the goaf forms the first top-cutting and roadway retaining section.

6. The three-dimensional ventilation method of claim 1, further comprising the steps of:

providing a plurality of ventilation lines of the ventilation system;

feeding air through the gas drainage air inlet roadway, the working face transport gate and the working face track gate, and returning the air through the gas drainage air return roadway;

diverting a first part of inlet air of the working face transport gate to the coal mining working face and merging the first part of the inlet air with the inlet air of the working face track gate, and then passing the first roof-cutting and roadway retaining section and the first process roadway in turn, then entering the gas drainage air return roadway to form return air; and diverting a second part of the inlet air of the working face transport gate to the second roof-cutting and roadway retaining section, then merging the second part of the inlet air with the inlet air of the gas drainage air inlet through the second process roadway, and then forming return air that enters the gas drainage air return roadway.

7. The three-dimensional ventilation method of claim 6, wherein, during the stopping process of the working face, a part of the working face track gate located in the goaf forms the first roof-cutting and roadway retaining section, and a part of the working face transport gate located in the goaf forms the second roof-cutting and roadway retaining section.

8. A three-dimensional ventilation system for mining by 110 construction method of coal and gas outburst mines, wherein:

the ventilation system comprises an air inlet main roadway, an air return main roadway, a coal mining face, a working face transport gate, a working face track gate, a gas drainage air inlet roadway, a gas drainage air return roadway, a first roof-cutting and roadway retaining section and a second roof-cutting and roadway retaining section;

a part of the working face track gate located in a goaf forms the first roof-cutting and roadway retaining section and/or a part of the working face transport gate located in the goaf forms the second roof-cutting and roadway retaining section;

the ventilation system further comprises a first process roadway or a second process roadway, one end of the first process roadway is connected with an end of the first roof-cutting and roadway retaining section away from the air return main roadway, the other end of the first process roadway is connected with the gas drainage air return roadway, one end of the second process roadway is connected with an end of the second roof-cutting and roadway retaining section away from the air inlet main roadway, the other end of the second process roadway is connected with the gas drainage air inlet roadway.

* * * * *